US007134699B1

(12) United States Patent
Kondratuk

(10) Patent No.: US 7,134,699 B1
(45) Date of Patent: Nov. 14, 2006

(54) LOCKING ROTARY LATCH

(75) Inventor: Michael W. Kondratuk, Cameron, WI (US)

(73) Assignee: Hardware Specialties, Inc., Spooner, WI (US)

( * ) Notice: Subject to any disclaimer, the term of this patent is extended or adjusted under 35 U.S.C. 154(b) by 40 days.

(21) Appl. No.: 10/410,692

(22) Filed: Apr. 11, 2003

(51) Int. Cl.
*E05B 13/00* (2006.01)

(52) U.S. Cl. ..... 292/359; 292/226

(58) Field of Classification Search ..... 292/226, 292/359, 219, 220, 228, 202, 203, 207, 358
See application file for complete search history.

(56) References Cited

U.S. PATENT DOCUMENTS 1,956,388 A * 4/1934 Loeser ..... 70/416
2,707,121 A * 4/1955 Behnke ..... 292/228
2,801,869 A * 8/1957 George ..... 292/226
RE24,426 E * 2/1958 Quinn ..... 292/67
2,929,651 A * 3/1960 Friedman et al. ..... 292/228
2,950,137 A * 8/1960 Check ..... 292/228
2,978,267 A * 4/1961 North et al. ..... 292/169.14
3,951,444 A * 4/1976 Shull ..... 292/359
4,867,491 A * 9/1989 Arnold ..... 292/150
5,072,976 A * 12/1991 Meszaros ..... 292/207
5,203,449 A * 4/1993 Bonardi ..... 206/1.5
5,909,919 A * 6/1999 Wang ..... 292/359

* cited by examiner

*Primary Examiner*—Gary Estremsky
(74) *Attorney, Agent, or Firm*—Moss & Barnett, P.A.

(57) ABSTRACT

The present invention is a rotary locking latch assembly including a rotary handle carrying a rotary latch bolt. The rotary handle is biased in a neutral, locked orientation that positions the bolt in engagement with a latch strike secured to a door jam, retaining the door in its closed position. Upon rotation of the handle, the bolt is misaligned with the latch strike, permitting the door to be opened. The latch assembly includes a spring biased lock plate with a locking feature. The lock plate is moveable between a unlocked position that allows the latch handle to freely rotate and a locked position that engages the spindle or handle to which the handle is secured, preventing rotation of the handle. Optional features on the lock plate or tab connected to the lock plate may lock the bolt to create a deadbolt, or include an automatic unlocking feature.

3 Claims, 20 Drawing Sheets

LOCKING ROTARY LATCH

FIELD OF INVENTION

The present invention relates to a locking rotary latch for a hinged door.

RELATED ART

A common door latch includes a handle rotatably mounted by its base at an edge of a door. The handle is spring biased in a latched position with its nose (or a latch bolt) extended outward from the edge of the door for engagement with a latch strike secured to a door jamb. Upon rotation of the handle, the handle nose or latch bolt is rotated away from engagement with the latch strike, permitting the door to be opened. Such a rotary latch is typically locked by moving a lock key into engagement with a notch in the handle base while the rotary latch is in the latched position, preventing rotation of the handle with the handle nose or latch bolt in engagement with the latch strike.

These latches can be rotated out of their locked position if the key locks are not fully seated in the handle notch. The key locks are small and provide limited resistance to forced rotation of the door handle, creating susceptibility to forced entry. Occasionally, door modification is required to install these latches which may be designed exclusively for either left or right handed doors.

There is a need for a locking rotary latch that is inexpensive to construct, compact in size, simple in construction and flexible in use. There is also a need for a locking rotary lock that functions as a true deadbolt lock and that is symmetrical for use on both right and left handed doors without installer modification. The locking mechanism of the present invention can be utilized with any door latch that is dependent on rotation of a handle or a spindle for actuation.

BRIEF SUMMARY OF THE INVENTION

The rotary latch of the present invention includes a housing, a latch handle rotatably mounted by its base to the housing, a latch bolt rotatably secured to the handle for movement between an extended and retracted position, a spindle connected at one end to and rotatable with the handle, and extending therefrom into the housing for engagement with a lock plate, and a lock plate slideably mounted in the housing for movement between a locked position in engagement with the spindle to prevent rotation of the spindle, and an unlocked position that permits the spindle to freely rotate. In place of a spindle, the handle can also be formed to create a spindle extension into the housing.

The lock plate defines an opening through which the spindle extends. One end of the lock plate opening defines a locking feature, the other end of the lock plate opening is sized to prevent locking engagement between the lock plate and spindle (or spindle portion of the handle) to permit actuation of the spindle. When the lock plate is in the unlocked position, the "actuation" end of the lock plate opening allows free rotation of the spindle with respect to the lock plate, allowing the handle to be rotated to an open position and the door to be opened. When the lock plate is moved to the locked position, the spindle is engaged within the locking feature of the opening, preventing rotation of the spindle and handle, preventing the door from being opened. This arrangement creates a true deadbolt, a bolt incapable of being unlocked unless the lock itself is intentionally released. The lock is supported by the strength of the spindle and lock plate and is resistant to forced rotation of the handle.

DETAILED DESCRIPTION OF THE INVENTION

The present invention of a locking rotary latch will be described as it applies to its preferred embodiments. It is not intended that the present invention be limited to the described embodiments. It is intended that the invention cover all modifications, equivalents and alternatives which may be included within the spirit and scope of the invention.

Figure 1:
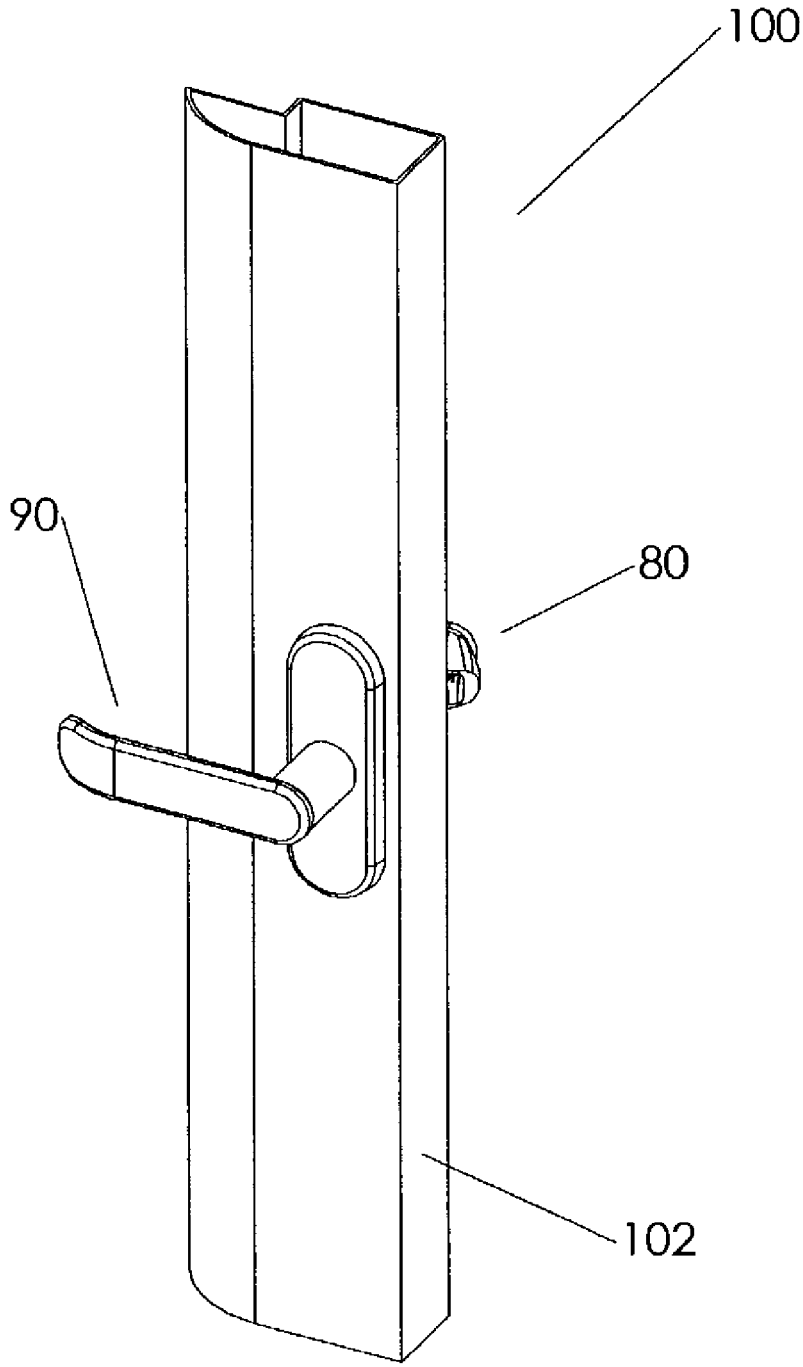
FIG. 1 is an isometric view of a door section with a rotary latch mounted thereon, highlighting the outside latch assembly.
Figure 2:
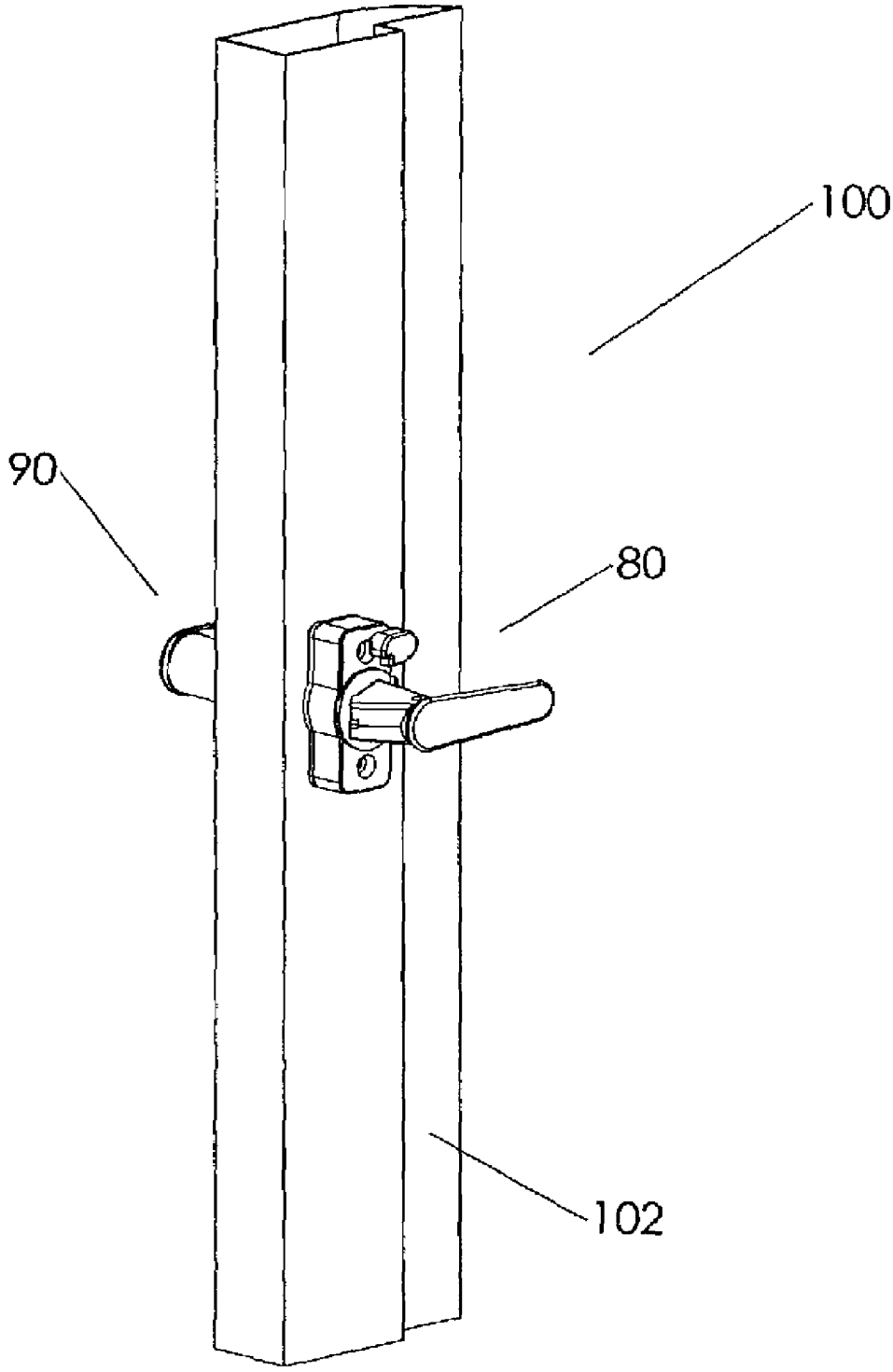
FIG. 2 is an isometric inside view of a door section with a rotary latch mounted thereon, highlighting the inside latch assembly.
Figure 3:
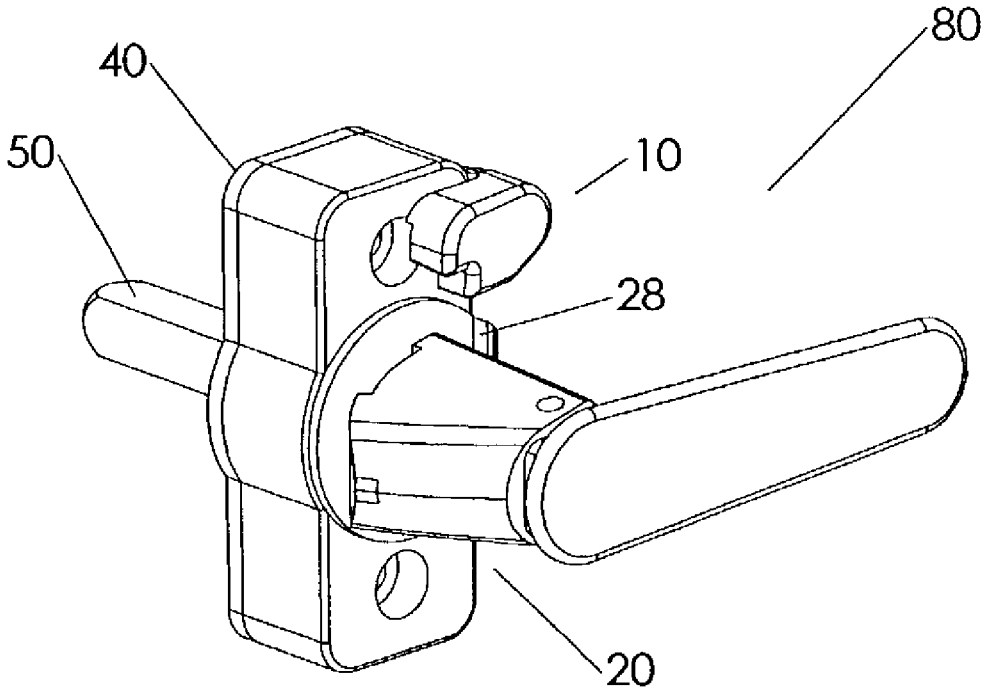
FIG. 3 is an isometric view of a first preferred embodiment of the rotary latch assembly in an unlocked position.
Figure 4:
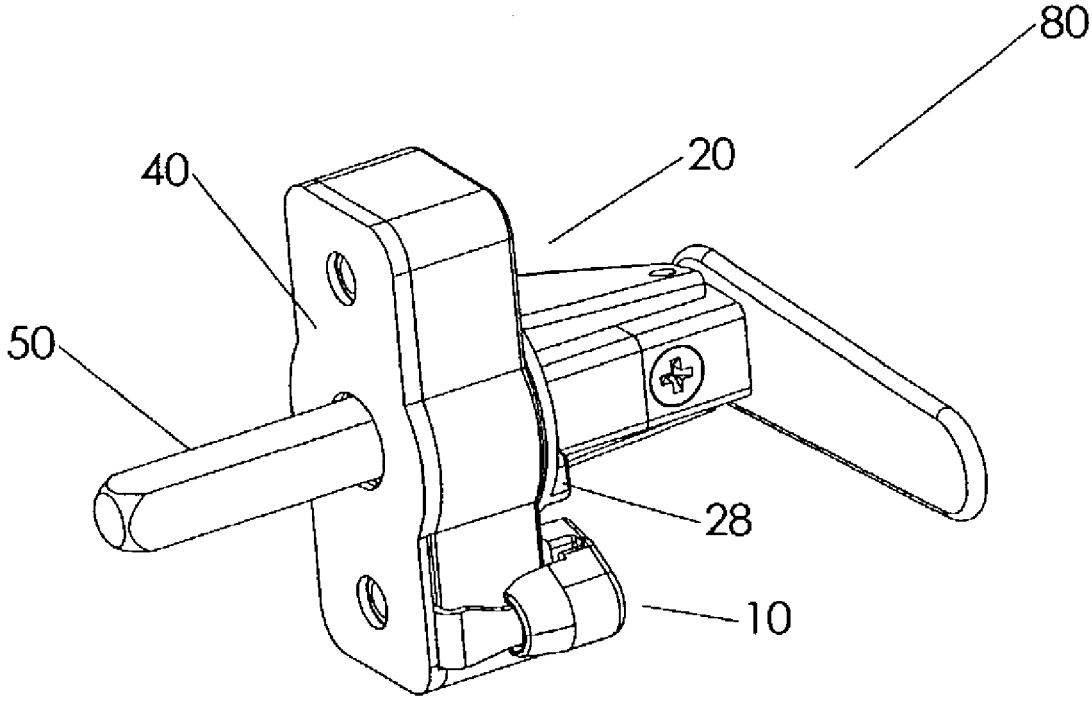
FIG. 4 is an isometric view of the rotary latch assembly shown in FIG. 3 from a different view point.

Referring now to the drawings, wherein like reference numerals and letters indicate corresponding structure throughout the several views, and referring in particular to FIG. 1, there is shown a preferred embodiment of the rotary latch assembly 100 according to the present invention, including an inside rotary latch assembly 80 and an outside latch assembly 90 mounted to a section of door 102. The general components of this preferred embodiment of the present invention are generally disclosed in FIG. 5.

Figure 5:
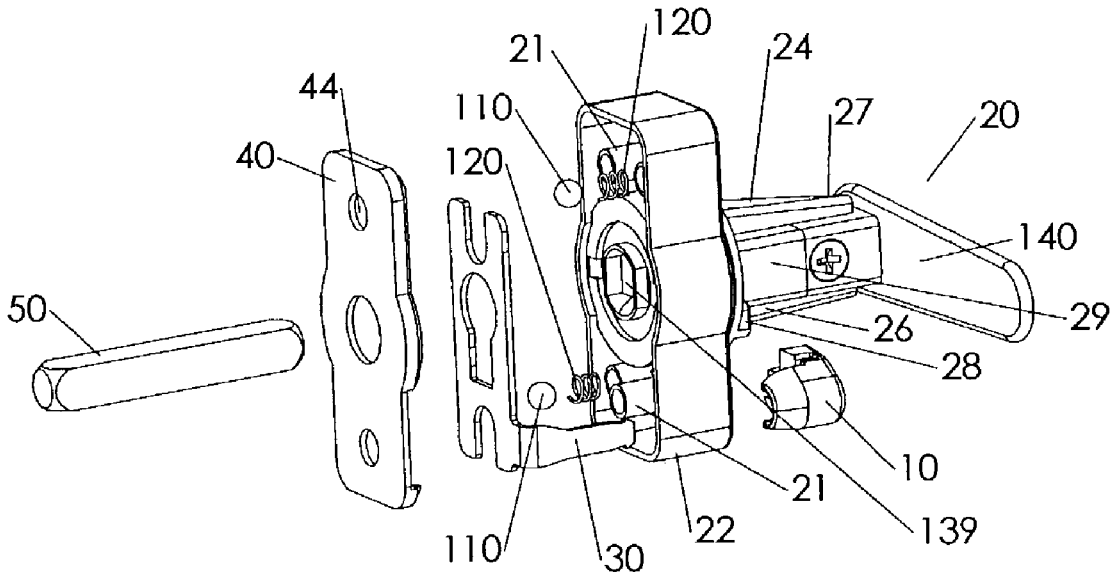
FIG. 5 is an exploded view of the rotary latch assembly illustrating the main latch, ball and spring, lock plate, base and spindle.
Figure 11:
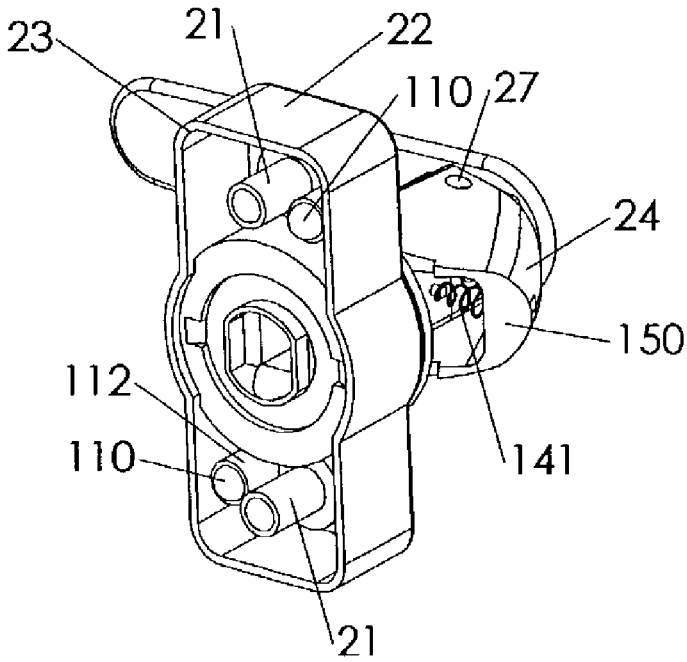
FIG. 11 is an isometric view of the rotary latch assembly with the base and lock plate removed, illustrating the position of the lock balls.
Figure 30:
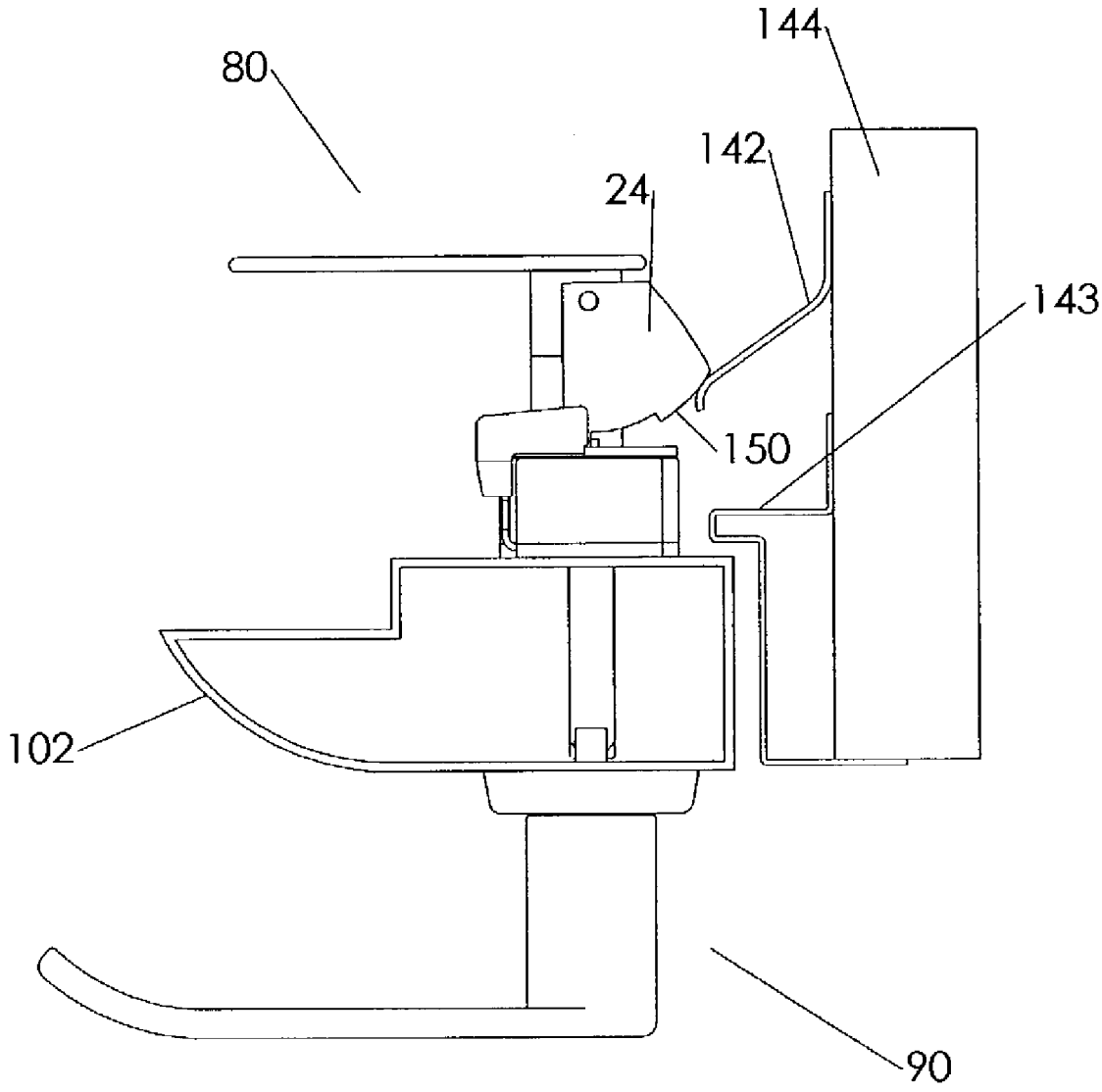
FIG. 30 is a top view of a typical installation showing the complete rotary latch mounted on a door section as related to the jamb, z-bar, and the latch strike.

As shown in FIGS. 5 and 30, a first preferred embodiment of the locking rotary latch 100 of the present invention includes a latch mechanism 20, a lock plate 30, a spindle 50, and a bias mechanism. (The bias mechanism may be traditional art, uniquely applied to fix the position of the lock plate. In FIGS. 11 and 30, a lock ball 110 and a ball spring 120 are utilized for this purpose.) The first preferred embodiment is illustrated with an optional base 40.

Figure 14:
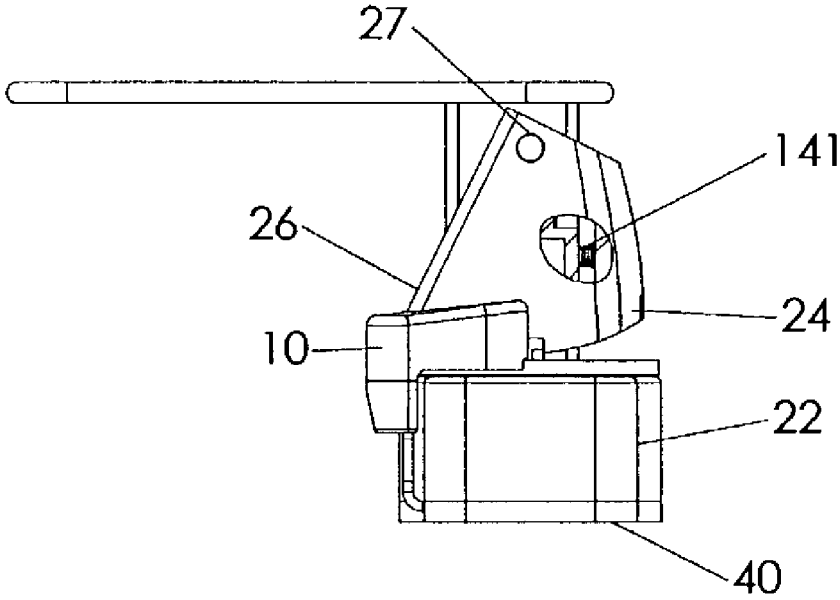
FIG. 14 is a side view of the rotary latch assembly of FIG. 3 with the bolt retracted and a broken section showing the latch bolt spring.

The latch mechanism 20 includes a housing 22 to which a handle base 29 is rotatably mounted. Handle base 29 supports a handle 140 at a first end and defines a spindle receptacle 139 for receiving spindle 50 at a second end. Although not illustrated, handle base 29 can also be formed with an extension from its second end that substitutes for the spindle, rather than a spindle receptacle. A bolt 24 is rotatably mounted to the handle base 29 for rotation about an axis 27. Bolt 24 rotates between an extended position extended outward from the handle 140 as shown in FIG. 30, and a retracted position closed on the door handle 140 as shown in FIG. 14. As shown in FIG. 30, the bolt 24 has an engagement surface 150 designed to engage a latch strike 142 secured to a doorjamb 144 when the door 102 is in its closed orientation abutting a z-bar 143 of doorjamb 144.

Housing 22 is equipped with tubular boss 21 to accommodate screws, bolts, rivets or similar means to secure the housing and base 40 to the door 102. The fasteners extend through the hollows formed in the boss 21 and the mount clearance openings 44 of base 40 into a door. An optional configuration is to stake a portion of the housing which will constrain the base 40 to the other components of the latch assembly 100. (Staking involves use of posts extended from the housing into engagement with post holes in the base plate. The posts are blunted to prevent retraction from the post holes, fixing the base plate to the housing.)

Figure 15:
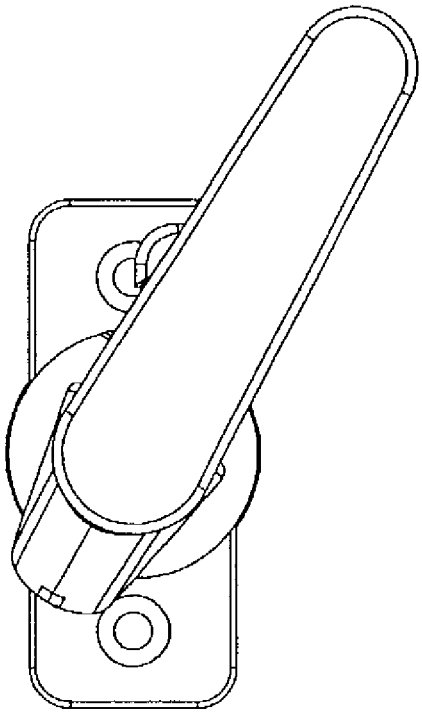
FIG. 15 is a front view of the rotary latch assembly, as seen from inside the door, rotated in a counter-clock wise position.
Figure 16:
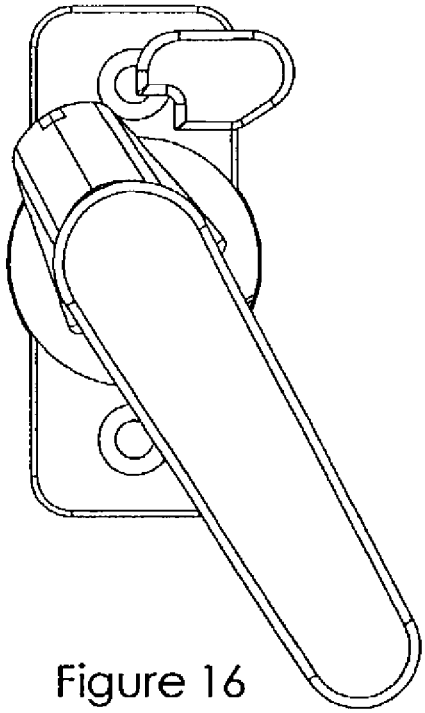
FIG. 16 is a front view of the rotary latch assembly rotated in a clock wise position.
Figure 18:
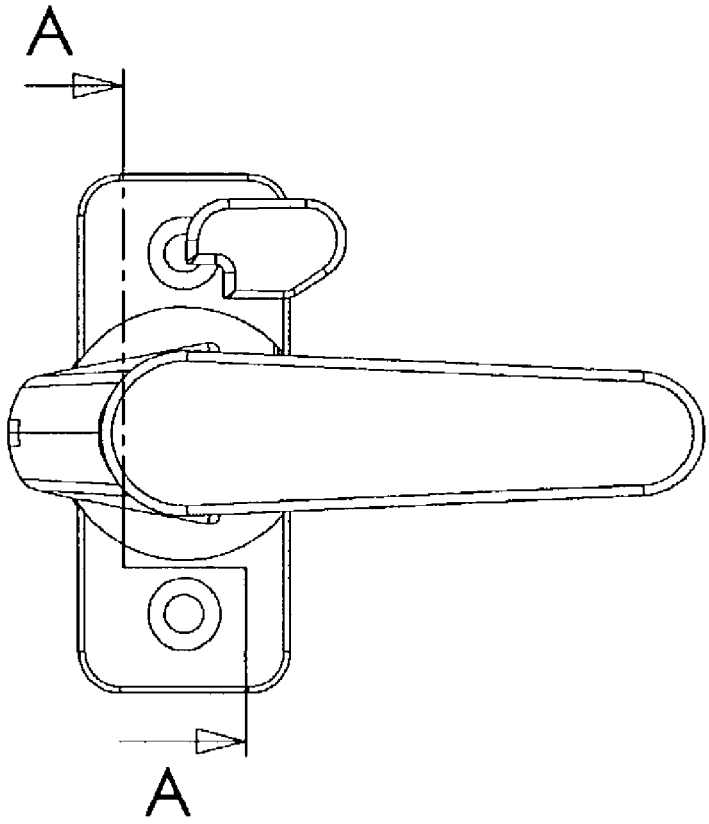
FIG. 18 is a front view of an unlocked rotary latch assembly in the neutral position.

The handle 140 is rotatable between a neutral, or closed position, with the handle 140 oriented substantially perpendicular to the doorjamb 144 as shown in FIG. 18, and an open position with the handle 140 oriented at an approximate 60 degree angle from its locked position as shown in FIGS. 15 and 16. A torsion spring (not shown) or other means can be used to bias the handle 140 in its closed orientation. (In an alternate preferred embodiment, not illustrated, the handle 140 can be equipped with a portion comprising a nose designed to engage a resilient latch strike 142 upon closure of the door. The door can be re-opened by rotation of the door handle 140 to its open position, so that the handle nose will clear the latch strike 142.)

Bolt 24 is biased back to its extended position by a latch bolt spring 141 as shown in FIGS. 11 and 14. With handle 140 is in its locked position and the bolt 24 in its extended position, bolt 24 contacts the latch strike 142 attached to the door jamb 144. This prevents the door from swinging open. The door can be opened by either rotating the door handle 140 to its open position or, in another alternate embodiment illustrated in FIG. 32, by actuating a trigger 162 connected to the bolt 24 to rotate the bolt 24 to its retracted position, allowing bolt 24 to clear the latch strike and the door to be opened.

Figure 9:
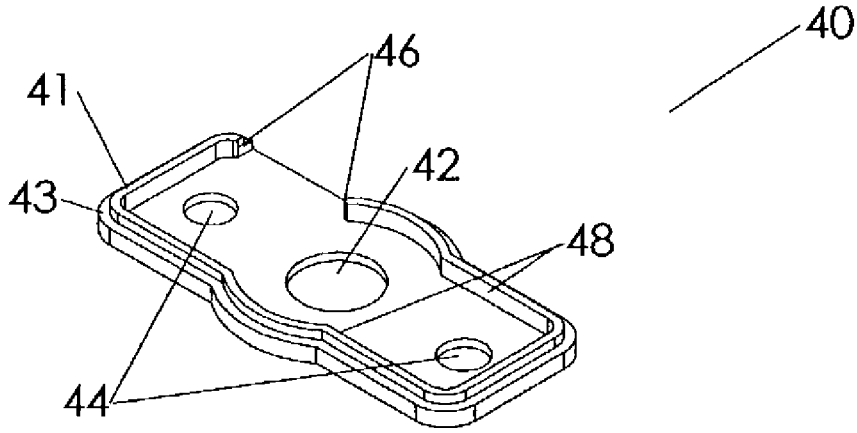
FIG. 9 is an isometric view of the base.

Optional base 40, as illustrated in FIG. 9, includes a perimeter ridge 41 set back from the outer edge of the base 40 to form a perimeter base stop 43 for engaging the lip 23 of housing 22. Base 40 further includes a spindle clearance hole 42 for receiving the spindle 50, mount clearance holes 44, and a perimeter ridge opening 46 through which a stem 31 of lock plate 30 extends. A lock plate guide 48 is formed on the inward facing surface of the ridge 41 for guiding the lock plate 30 between a locked position and an unlocked position. When base 40 is mounted to housing 22, the perimeter ridge 41 and base stop 43 of base 40 engage the lip 23 of housing 22 to lock the base 40 into position relative to the housing 22. The lock plate 30 is slideably mounted within the guide 48 of base 40 for movement between its locked and unlocked positions. (In the absence of a base, the housing is secured directly to the door and, optionally, a shim of durable, low friction material, such as plastic, can be placed between the door and lock plate 30 to minimize wear and reduce friction during movement of the lock plate 30. The guide would then be an extension of the housing side wall.)

Figure 8:
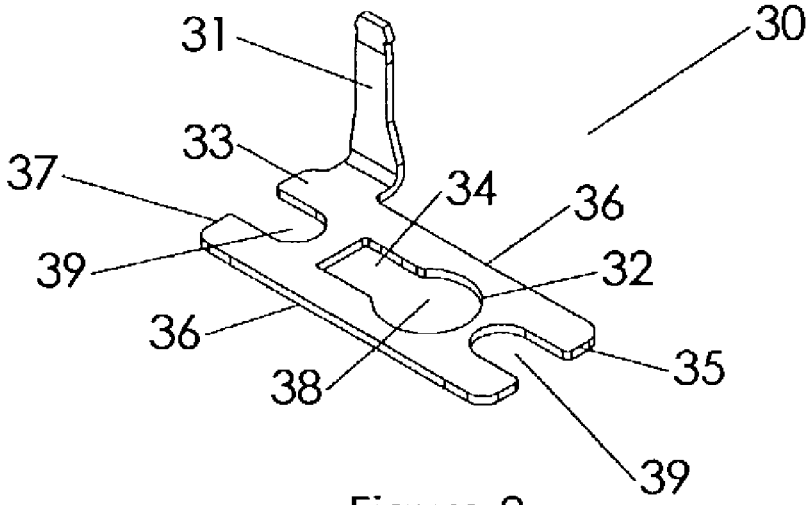
FIG. 8 is an isometric view of the lock plate.

Lock plate 30, as illustrated in FIG. 8, includes a stem 31 by which the lock plate 30 is manipulated between its locked and unlocked position. The face 33 of lock plate 30 further includes a lock plate spindle hole 32 through which spindle 50 extends. One end of the spindle hole 32 is generally circular (although other configurations are possible) and is larger in cross section than the cross sectional measurements of spindle 50. The wide end of spindle hole 32 is identified at 38 in FIG. 8. When the spindle 50 is aligned within this actuation opening, the lock plate 30 permits rotation of the spindle 50 and actuation of the door handle 140. A second end of spindle hole 32 defines a locking feature, a rectangular shaped lock opening 34 for engaging the spindle 50 in locking relation. The lock opening 34 is of a width and shape that corresponds to the cross-sectional width and shape of the spindle 50. When the spindle 50 is aligned within this locking feature, the spindle 50 can not be rotated rendering the door handle inoperable in the closed position, creating a locked position.

Figure 6:
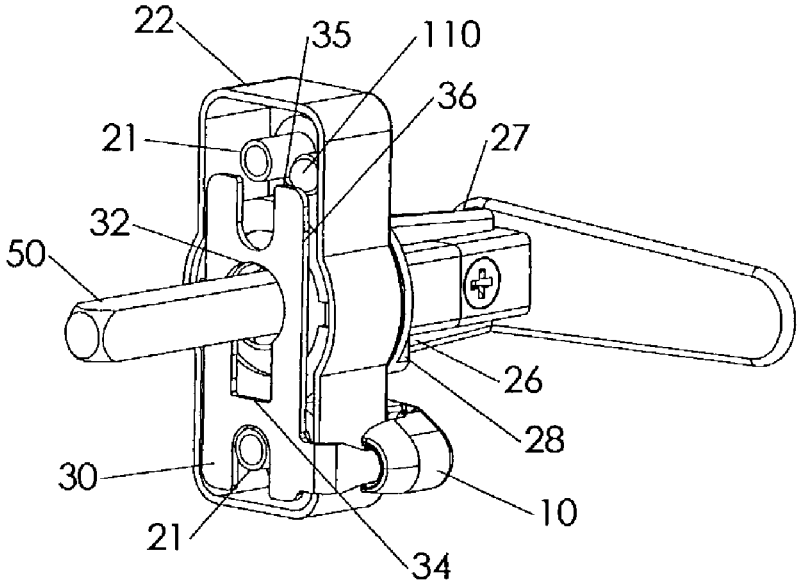
FIG. 6 is an isometric view of an assembled rotary latch assembly with the base removed.
Figure 7:
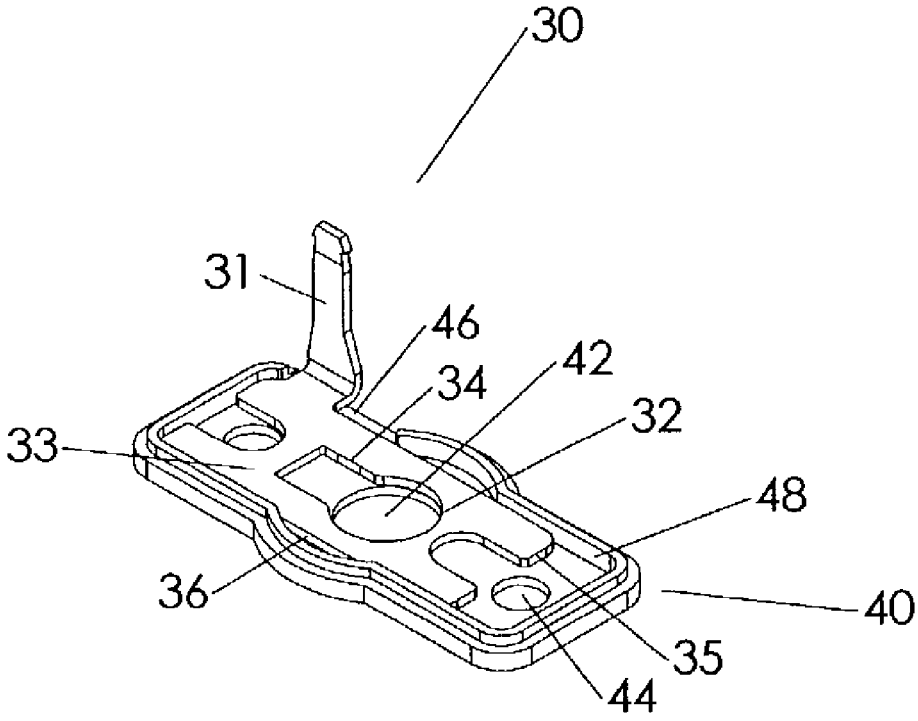
FIG. 7 is an isometric view of the assembled base and lock plate.
Figure 17:
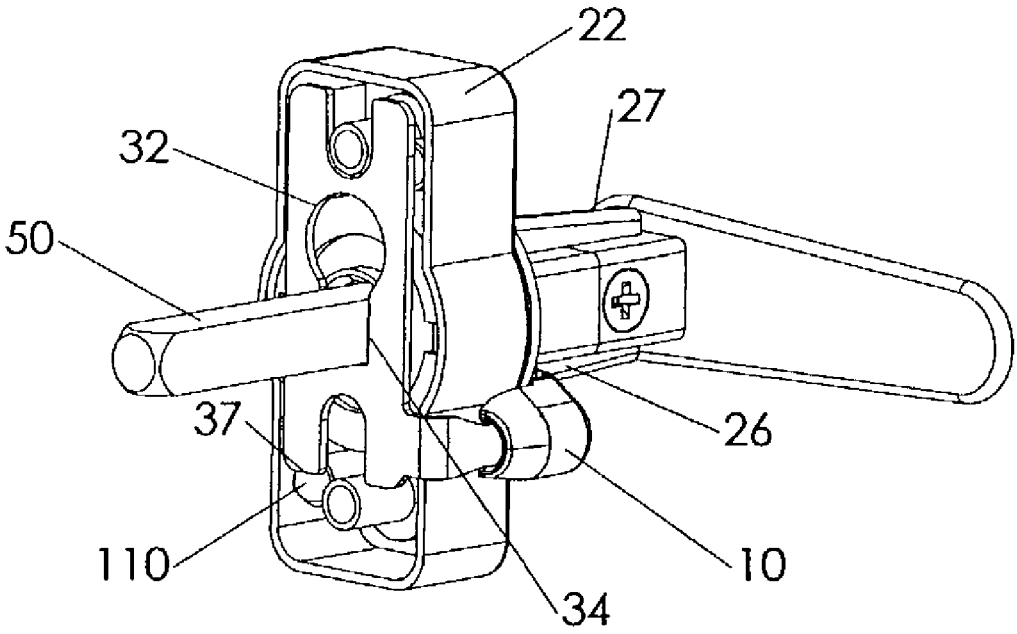
FIG. 17 is an isometric view of the rotary latch assembly shown in a locked position.

Lock plate 30 is shown in its locked position in FIG. 17 with spindle 50 engaged within lock opening 34. In this orientation, spindle 50 and handle 140 cannot be rotated, maintaining handle 40 in its locked orientation. As shown in FIG. 6, lock plate 30 is positioned in the unlocked position, with spindle 50 freely rotatable within circular end 38 of lock plate spindle hole 32. This allows the handle to be rotated from its neutral or latched orientation to its unlocked orientation, permitting the door to be opened. It should be noted that circular end 38 of spindle hole 32 may be formed in any shape provided the dimensions of the hole are larger than the diameter of the spindle 50, so that free movement of the spindle 50 is permitted within the actuation end of the spindle hole 32.

At opposite ends of locking plate 30 are opposite facing u-shaped mount clearance openings 39 required to avoid interference between lock plate 30 with the fasteners used to secure the rotary latch assembly 100 to a door, when rotary latch 30 is moved between its locked and unlocked positions. Side edges 36 define contact surfaces for engagement with the guide 48 of base 40. End edges 35 and 37 of the lock plate 30 engage the spring biased lock balls 110 to hold the lock plate 30 in its unlocked or locked position.

The lock plate 30 is mounted within base 40 and housing 22, such that lock plate stem 31 extends through the perimeter ridge opening 46. The guide surface 48 of ridge 41 engages the side edges 36 of lock plate 30 to direct the lock plate 30 between its locked and unlocked positions. End edges 35 and 37 of lock 30 engage the ridge 48 of base 40 to limit the travel of the lock plate 30 within the housing 22. In the unlocked position, lock spindle clearance hole 32 of lock plate 30 is axially aligned with base spindle clearance hole 42 of base 40, permitting rotation of spindle 50 (either clockwise or counter-clockwise), to unlatch a door. To place the lock plate 30 in a locked position, lock plate 30 is slid within the guide 48 until lock opening 34 is axially aligned with spindle clearance hole 42 of base 40. In this position, spindle 50 is engaged by the walls of lock plate 30 that define lock opening 34, as shown in FIG. 17, to prevent rotation of spindle 50. To lock the handle 140 in the locked position, handle 140 must be in the neutral position when its lock plate 30 is slid into the locked position. If handle 140 is rotated 90 degrees, clockwise or counterclockwise when the lock plate 30 is moved to the locked position, the handle 140 will be locked in an open position, allowing the door to act as a free swinging door.

Figure 24:
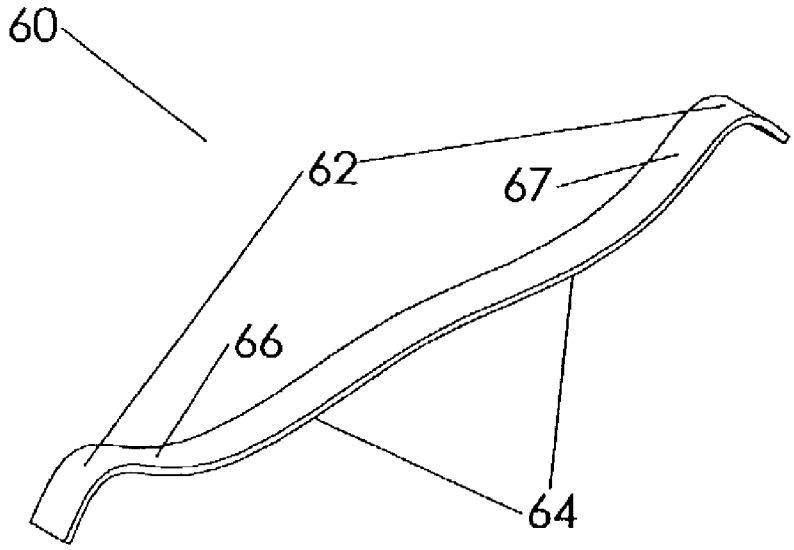
FIG. 24 is an isometric view of the leaf spring used in the alternative embodiment of the rotary latch assembly.

To prevent unintended movement of the lock plate 30 between the locked and unlocked positions, a bias system is utilized to fix the lock plate 30 in its desired position. In a preferred embodiment of the invention, shown in FIGS. 22–29, a leaf spring 60 is utilized to bias the lock plate 30 in its locked and unlocked positions. Leaf spring 60, as shown in FIG. 24, includes two lock plate contact surfaces 62, housing constraint surfaces 64, a locked biasing surface 66 and an unlocked biasing surface 67. The base 40 and lock plate 30 are mounted to housing 22 with leaf spring 60 supported between the lock plate 30 and housing support surface 25. See FIGS. 25 and 29.

Figure 10:
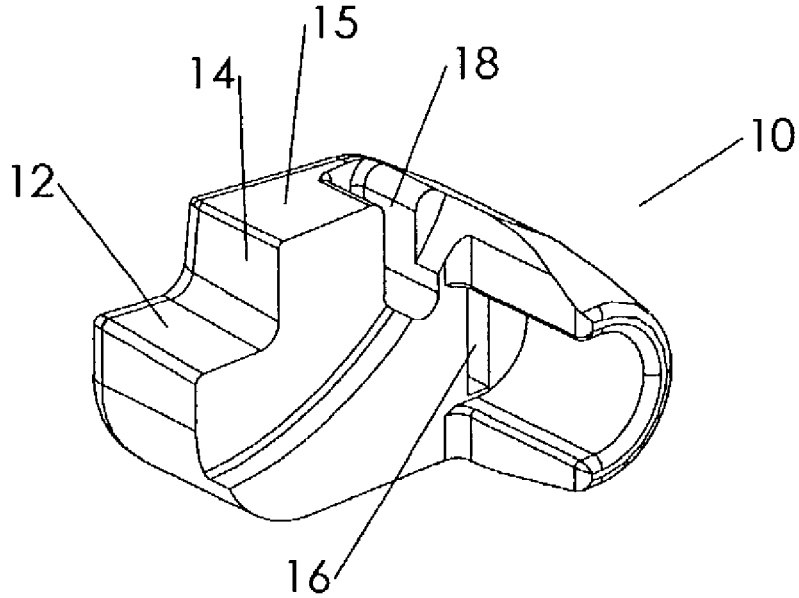
FIG. 10 is an isometric view of a lock tab.
Figure 19:
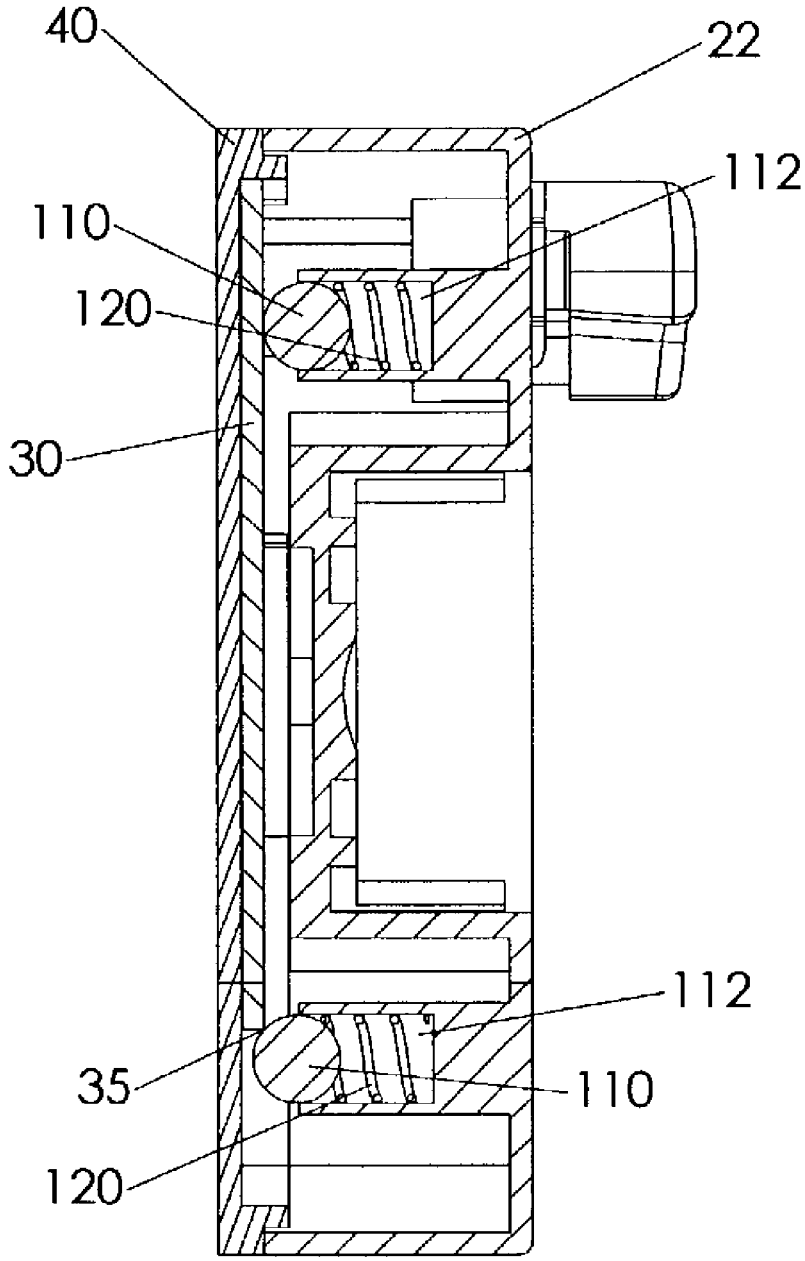
FIG. 19 is a section view of FIG. 18 along the line A—A, showing only the housing, lock balls, ball springs, tab, lock plate and base.
Figure 20:
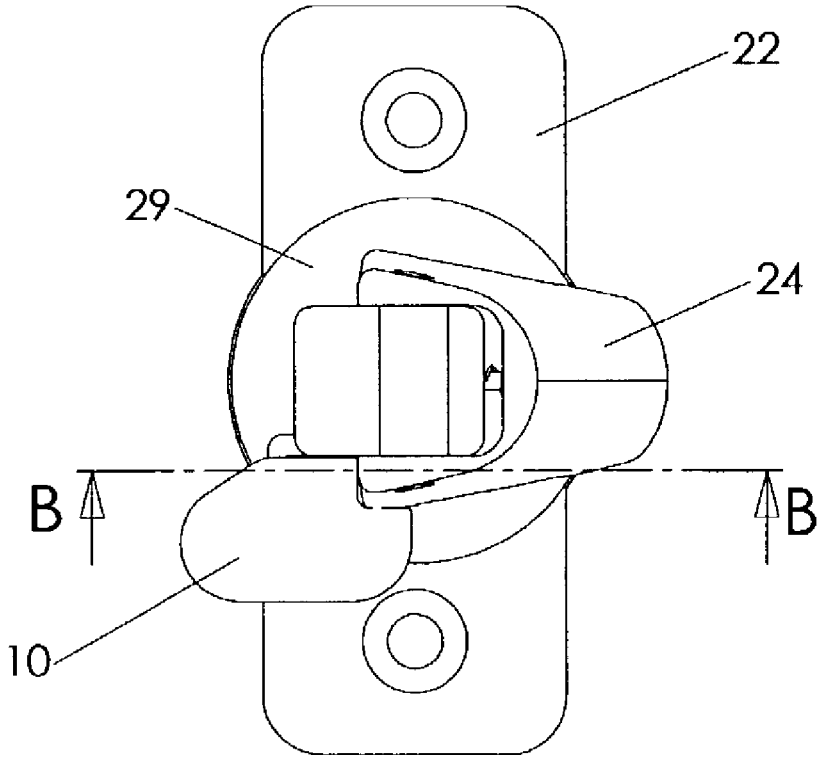
FIG. 20 is a front view of the locked latch with the handle removed.

Other bias systems known in the art may be utilized. For instance, the bias system shown in FIGS. 11 and 19 includes diagonally separated ball guides 112 at the top and bottom ends of the housing 22. The ball guides 112 receive a ball spring 120. One end of the ball springs 120 engage the wall of housing 22; the other end of the ball springs 120 engage lock balls 110. When the base 40 is secured to the housing 22 with lock plate 30 positioned within the housing 22, the ball springs 120 urge the lock balls 110 against the face 33 of the lock plate 30, which creates a friction fit between the lock plate 30 and base 40 preventing undesired or accidental movement of the lock plate 30. When the lock plate 30 is moved to its locked position, as shown in FIG. 17, one of the lock balls 110 is urged to extend partially beyond the end edge 37 of lock plate 30, preventing lock plate 30 from being moved out of the locked position unless the friction fit that exists between the lock ball 110 acting on the lock plate end edge 37, is overcome. When the lock plate 30 is moved to its unlocked position, as shown in FIG. 6, one of the lock balls 110 is urged to extend partially beyond the end edge 35 of lock plate 30, preventing lock plate 30 from being moved out of the unlocked position unless the friction fit that exists between the lock ball 110 acting on the lock plate end edge 35, is overcome. Secured to the free end of stem 31 of lock plate 30 is a tab 10. As shown in FIG. 10, tab 10 includes a stem receptacle 16 for mounting the tab 10 to stem 31 of lock plate 30, a side stop 12, a bolt stop 14, a handle base contact surface 15 and a fixed receiver 18. Tab 10 is shown press fit to stem 31, although other attachment mechanisms are possible, including without limitation, a slide mount permitting limited movement of tab 10 along the longitudinal axis of stem 31.

Figure 12:
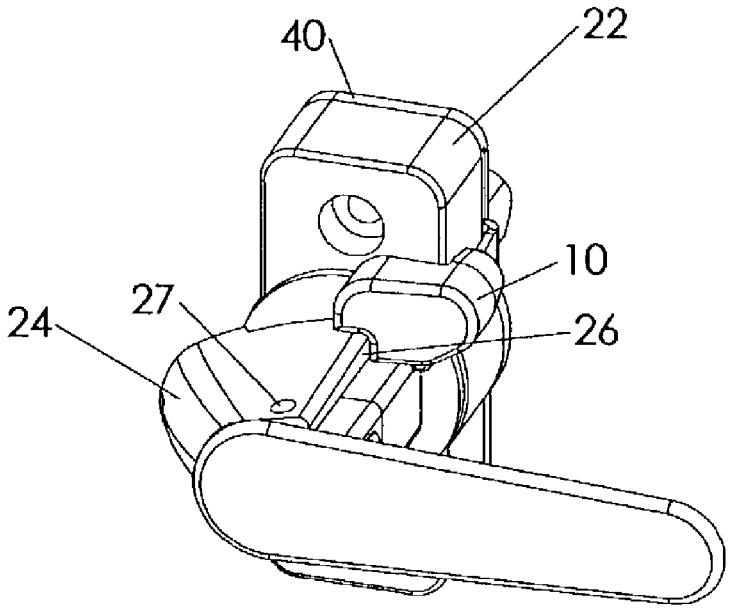
FIG. 12 is isometric view of the rotary latch assembly in a locked position.
Figure 13:
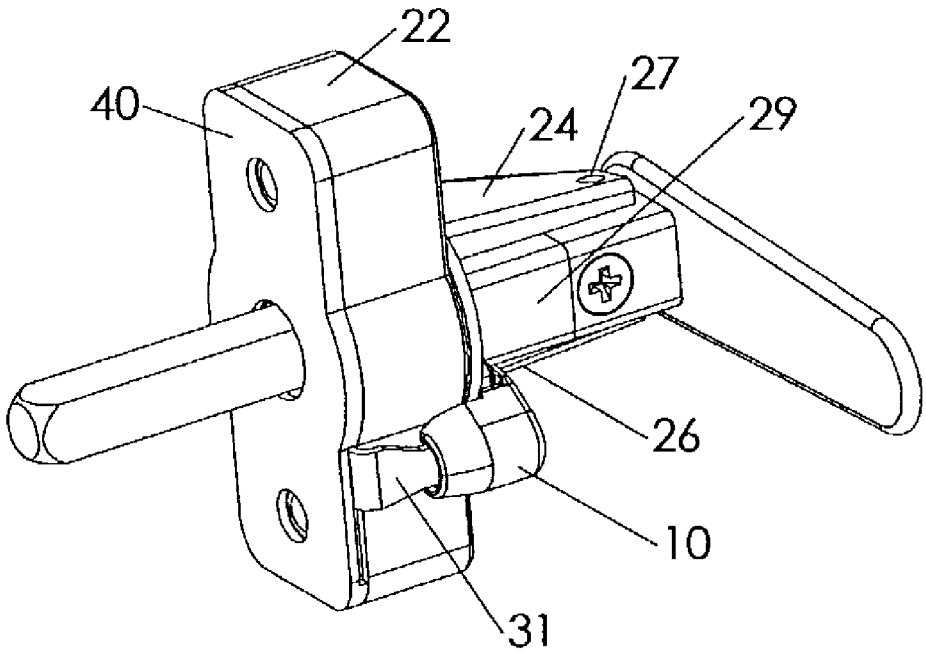
FIG. 13 is a isometric view of the rotary latch assembly of FIG. 12 from a different view point.

Lock plate 30 and stem 31 move transversely with respect to the direction of rotation of bolt 24. When lock 30 is moved from its unlocked position to its locked position, side stop 12 and bolt stop 14 of tab 10 are slid into engagement with an abutment edge 26 of bolt 24, with the handle base contact surface 15 of tab 10 in contact with the handle base 29, as illustrated in FIG. 12. If a retraction force is applied to bolt 24, bolt 24 will engage tab 10 and retraction of bolt 24 will be prevented by the rigidity of stem 31.

Figure 21:
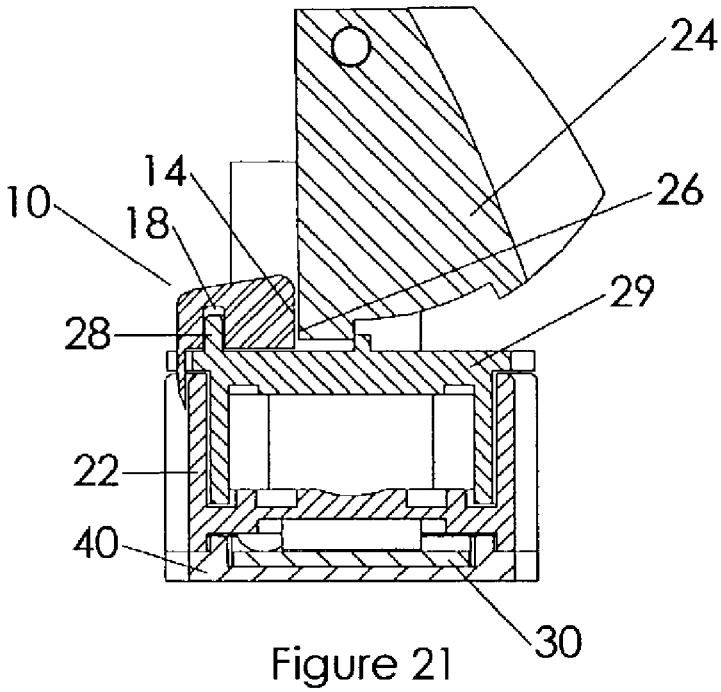
FIG. 21 is a sectional view along line B—B defined in FIG. 20 showing the tab, bolt, housing, handle base, lock plate, and base.
Figure 22:
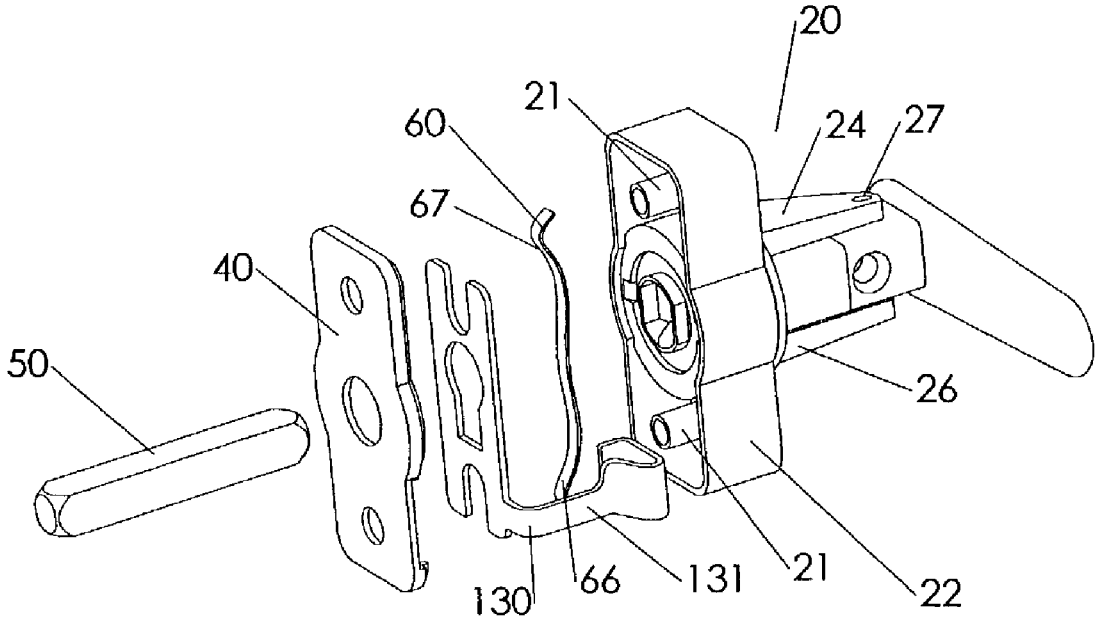
FIG. 22 is an exploded view showing an alternate preferred embodiment of the rotary latch assembly which utilizes a leaf spring instead of the lock balls, and has a lock plate which eliminates the tab.
Figure 23:
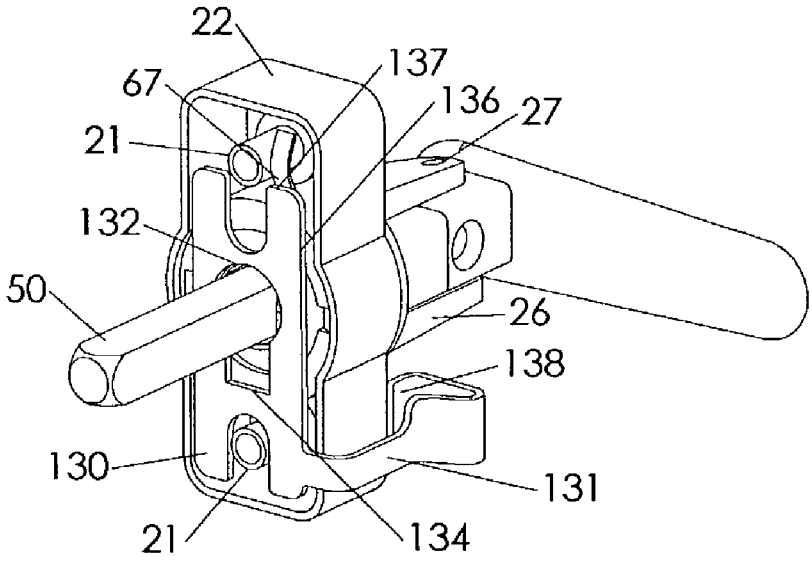
FIG. 23 is an isometric view of an unlocked assembled of the alternative embodiment of the rotary latch assembly with the base removed.

Referring to FIG. 21, the latch assembly is optionally equipped with a tab stop 28. When lock plate 30 is slid into the locked position with tab 10 in engagement with the bolt 24, the fixed receiver 18 of tab 10 is positioned over and in engagement with tab stop 28. In this orientation, a flex or movement of stem 31 in response to a retraction force applied to bolt 24 will be eliminated by the locking relationship of tab 10 and tab stop 28. Engagement of the handle base 29 and bolt 24 is concurrent with engagement of the walls of the lock plate lock opening 34 with spindle 50 to prevent both rotation of spindle 50 and retraction of bolt 24. This creates a true deadbolt situation.

As indicated, other methods of mounting tab 10 to stem 31 are possible, such as a slide, rotational, or adhesive mounted, each of which permits actuation of a locking relationship with the housing 22 and/or handle base 29 and/or bolt 24 to prevent retraction of the bolt 24. Additionally, the bolt stop may be incorporated in the lock plate as depicted in the alternative embodiment shown in FIG. 27.

The door operator may lock a door in a closed position by engaging the lock plate 30 and tab 10 after the door is closed with the handle 140 and bolt 30 in the locked and extended positions, respectively; or may lock a door in an always open position by engaging the lock plate 30 and tab 10 when the door is open with the handle 140 and bolt 30 in the locked and extended position, respectively). The door can also be locked in a free swinging position by engaging the lock plate 30 and tab 10 after the handle 140 has been rotated approximately 90° to its open position.

Figure 25:
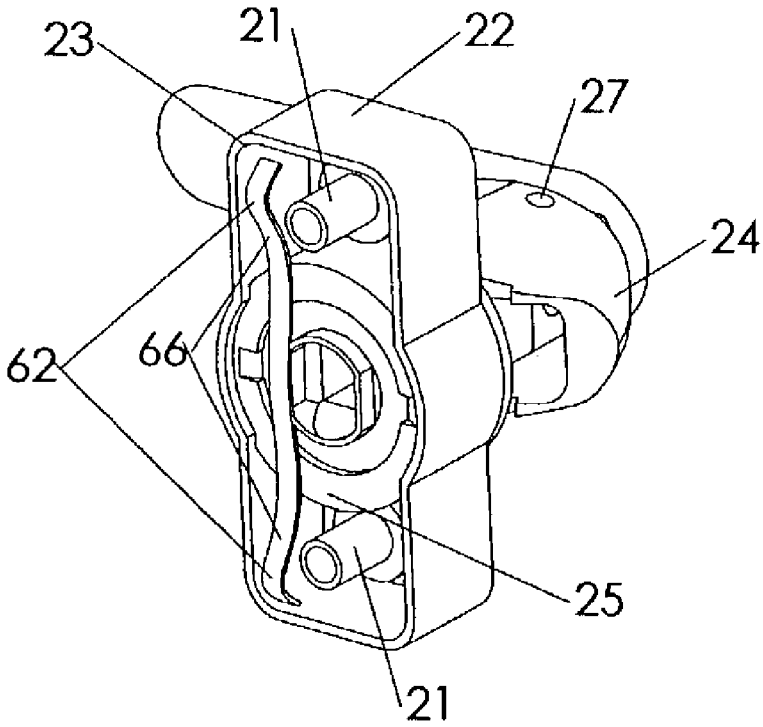
FIG. 25 is an isometric view showing the alternate embodiment of the latch and the leaf spring, with the lock plate and base removed.
Figure 26:
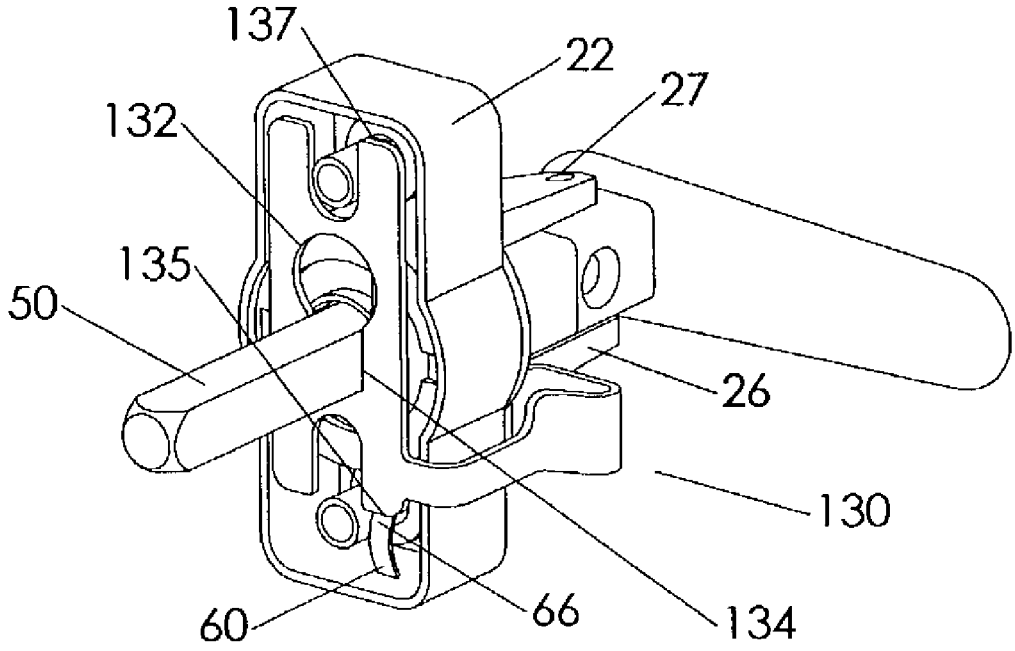
FIG. 26 is a isometric view of the locked alternative embodiment of the rotary latch assembly with the base removed.
Figure 27:
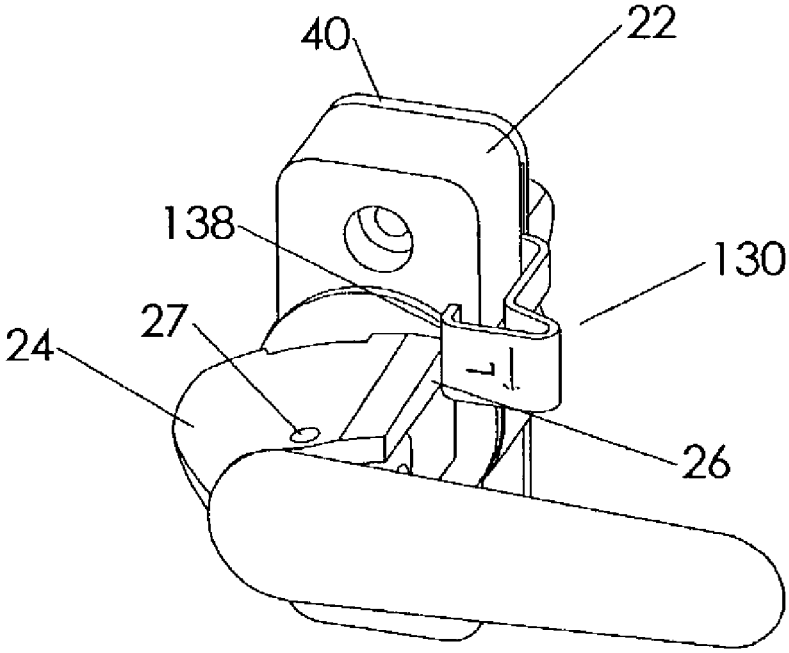
FIG. 27 is a isometric view of the alternate embodiment of the rotary latch assembly in a locked state.
Figure 28:
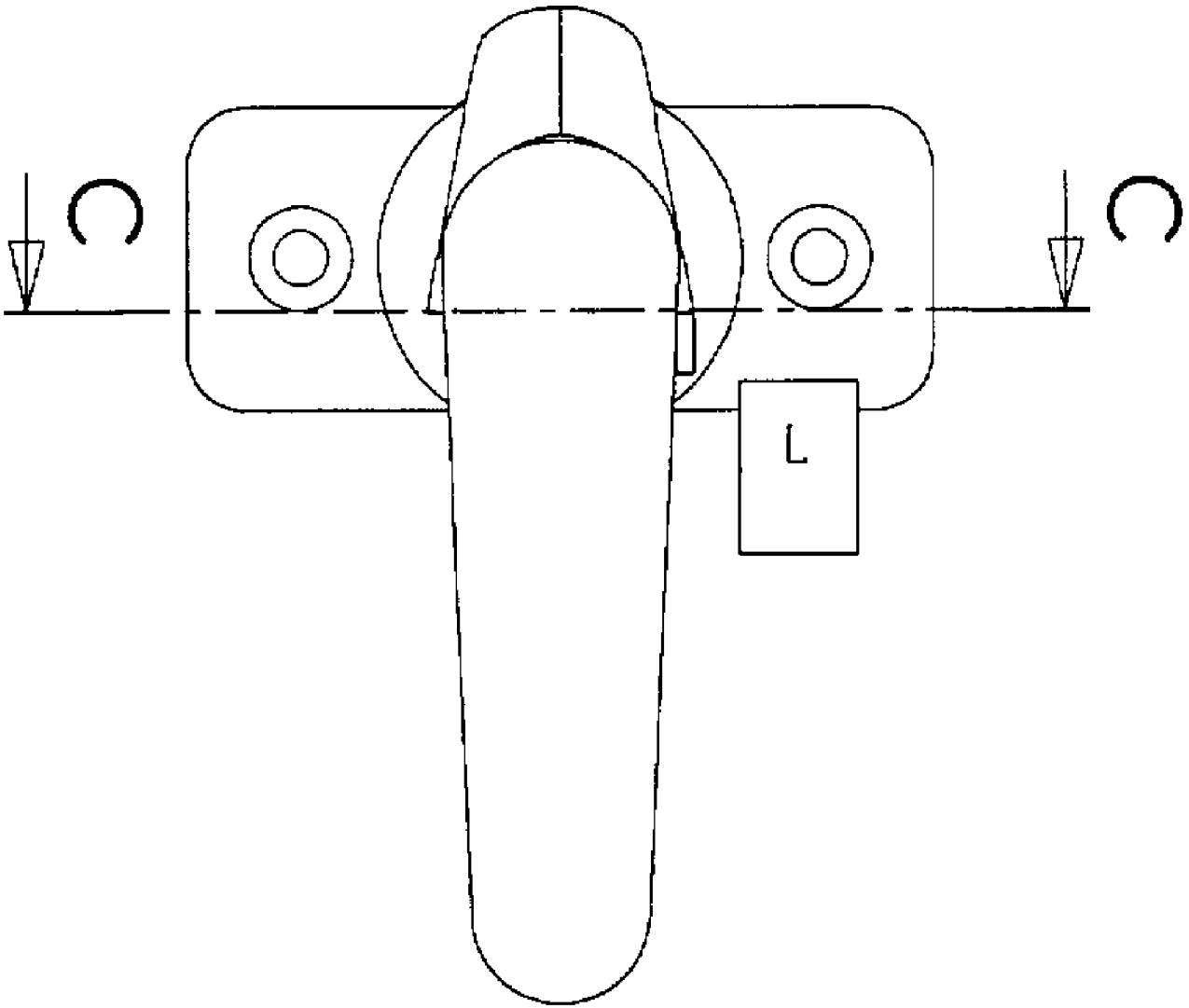
FIG. 28 is a front view of the alternative embodiment of the rotary latch assembly in the unlocked neutral position.
Figure 29:
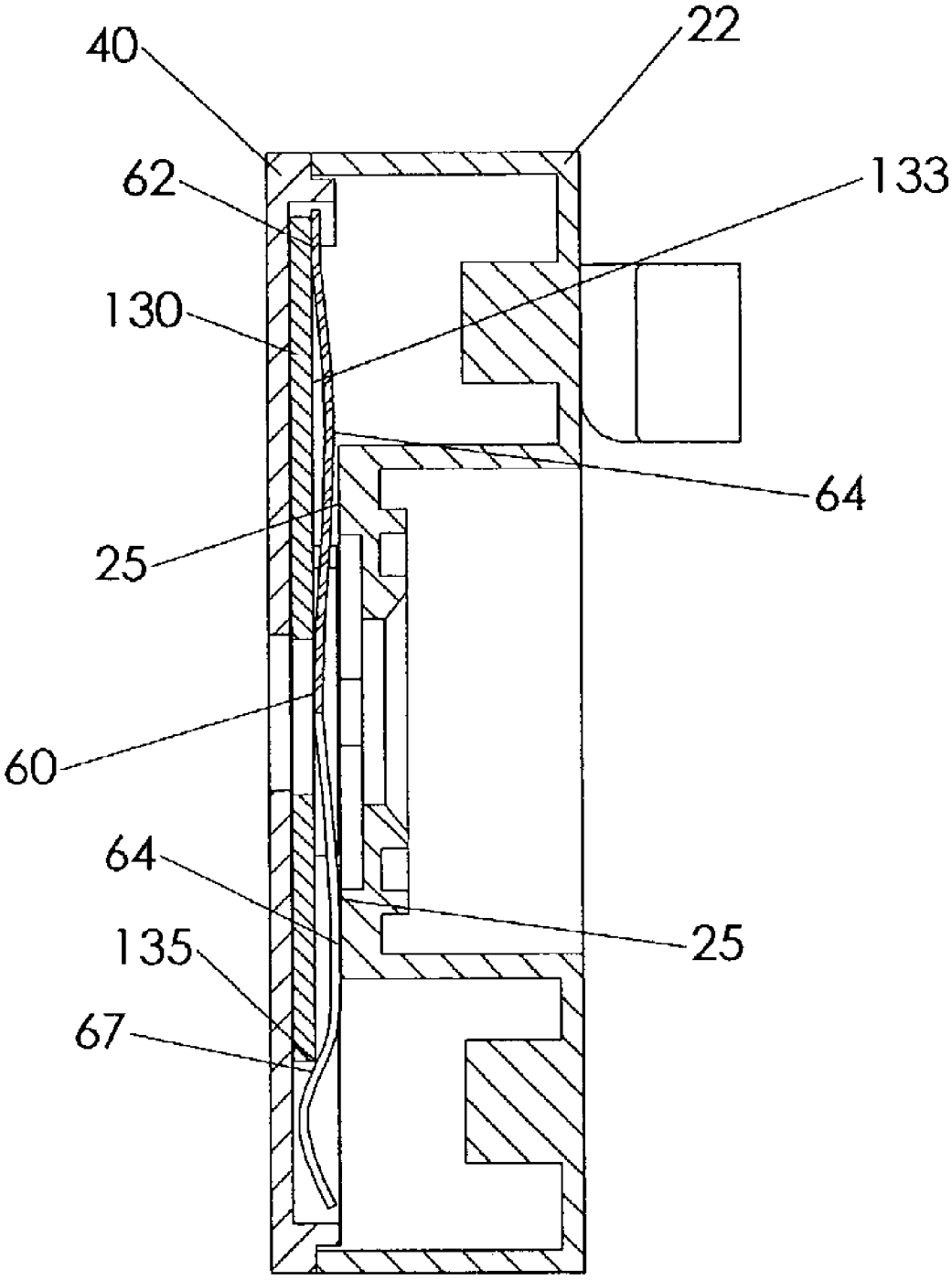
FIG. 29 is a sectional view along line C—C defined in FIG. 28 showing only the housing, leaf spring, lock plate, and base of the alternative embodiment of the rotary latch assembly.

In an alternative embodiment shown in FIGS. 25 and 26, leaf spring 60 is located between the alternate lock plate 130 and the housing 22. (Other constructional components, unless otherwise noted, are commonly employed in both the first and alternate preferred embodiments, and thus, for those common components, the same reference numerals will be used to refer to the same components.) The housing constraint surfaces 64 of leaf spring 60 contacts the support surface 25 of housing 22, and the lock plate contact surfaces 62 engage the face 133 of alternate lock plate 130 as shown in FIG. 29. When the alternate lock plate 130 is in the locked position, the locked biasing surface 66 of leaf spring 60 engages alternate lock plate edge contact 135 (FIG. 26), preventing movement of the lock plate 60 out of the locked position until and unless the biasing force of the leaf spring 60 against alternate lock plate 130 is overcome. Likewise, when the alternate lock plate 130 is in the unlocked position (FIG. 23), the unlocked biasing surface 67 of leaf spring 60 engages alternate lock plate edge spring contact surface 137 (FIG. 23), preventing movement of the lock plate 60 out of the unlocked position until and unless the biasing force of the leaf spring 60 against alternate lock plate 130 is overcome.

The alternate lock plate 130 has similar features to the first preferred embodiment—a lock plate spindle hole 132 with a locking feature 134, side edges 136 and lock plate edge spring contact surfaces 135 and 137, and stem 131. Alternate stem 131 defines an alternate lock plate bolt stop 138 that engages the handle base 29 and the abutment edge 26 of bolt 24 when the alternate lock plate 130 is moved to the locked position. Alternate lock plate bolt stop 138 prevents retraction of the bolt 24 from its extended (normal biased) position. As with the first preferred embodiment, if the alternate rotary latch assembly is locked when the door is closed and the handle 140 is in its locked (neutral) position, the door cannot be opened; if the alternate rotary latch assembly is locked when the door is open and the handle 140 is in the neutral position, the door will swing open but cannot be locked; if the handle 140 is rotated 90 degrees out of its neutral position and then locked using this alternate embodiment, the door will not latch and will swing freely upon application of an external force.

Figure 31:
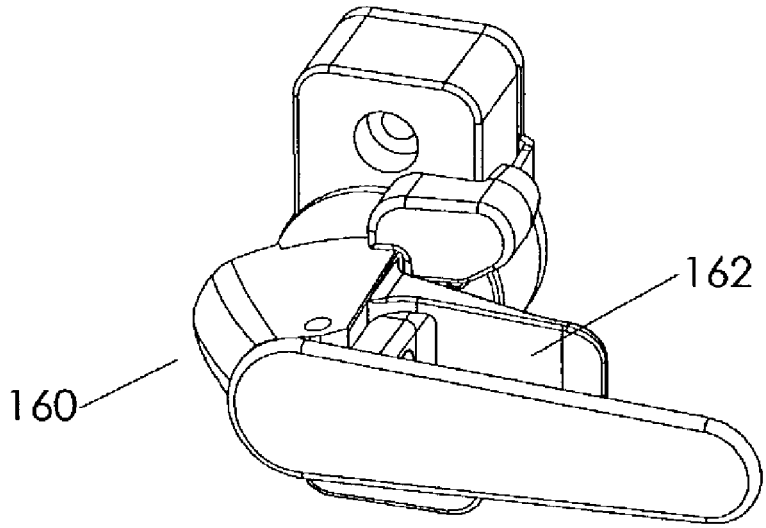
FIG. 31 is an isometric view of an alternate embodiment which incorporates a trigger actuated latch bolt.
Figure 32:
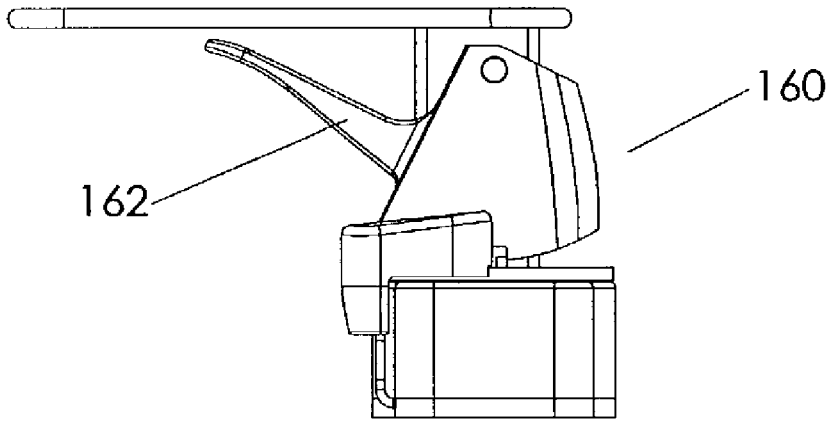
FIG. 32 is side view of the rotary latch assembly of FIG. 31 with the bolt retracted.

Another embodiment of a latch bolt is presented as 160 in FIGS. 31 and 32. In this embodiment, a trigger 162 is provided as an alternative means for disengaging the bolt 140 from the door latch strike 142. Trigger 162 is formed with or secured directly to bolt 24, preferably distant from the axis of rotation of the bolt 24, and is further aligned with the handle 140. Trigger 162 acts as a lever to rotate the bolt 24 from its normally biased extended position in engagement with latch strike 142, to a retracted position as shown in FIG. 32, allowing the door to be opened. Attaching the trigger 162 directly to the bolt 24 maximizes leverage, greatly simplifies actuation of the bolt 24 and simplifies construction, all without interference of the other attributes of the present invention.

The lock plate of the present invention can be utilized with different types of latch mechanisms that are dependent upon use of a spindle or handle with spindle characteristics, that is, any configuration where the lock plate can be actuated into a locked and unlocked relation with the handle, spindle or other component upon which rotation of the handle is dependent to prevent actuation of the handle to open a door. Although not illustrated, the lock plate may be mounted in various ways, including without limitation, rotatably, provided the lock plate can be moved between a first position in locking engagement with the spindle, handle or other component upon which rotation of the handle is dependent, and a second position that allows actuation of the handle.

Figure 33:
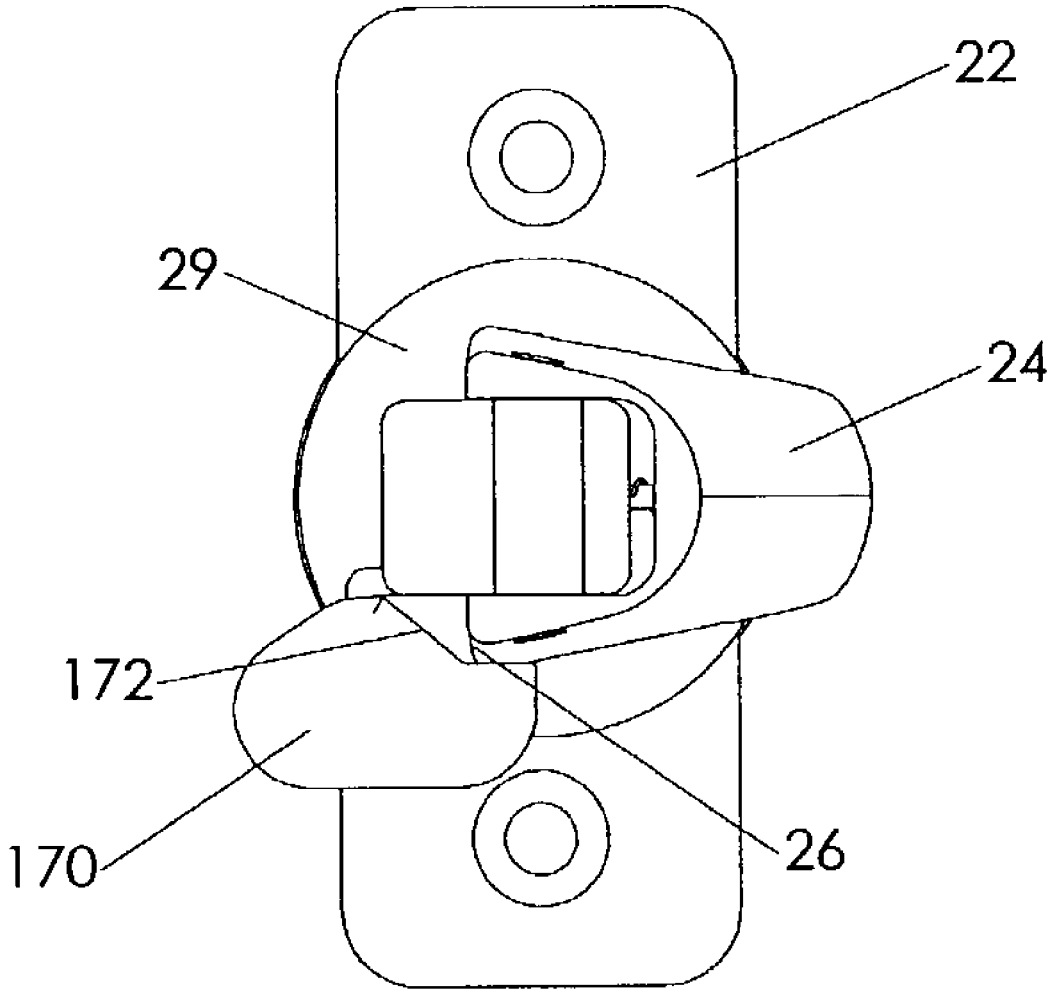
FIG. 33 is a top view of another preferred embodiment of the present invention illustrating an automatic unlock feature.

Another preferred embodiment is an automatic unlock feature, illustrated in FIG. 33. In this embodiment, tab 170 includes an inclined surface 172 for engagement with the abutment edge 26 of bolt 24. When a door is closed and the latch mechanism is locked (by movement of the lock plate 30 to its locked position), the door remains locked from the outside, but can be opened from the inside by merely applying a retraction force on the bolt 24. If the door latch assembly is in a locked orientation when the door is in the open position, when the door closes, the force of the bolt 24 engaging the door strike 142 causes the bolt 24 to retract. As bolt 24 retracts, the abutment edge 26 of bolt 24 engages the inclined surface 172 of alternate tab 170 causing alternate tab 170 and lock plate 30 to slide from the locked position to the unlocked position, unlocking the lock plate. With this embodiment, a door can be locked from the inside to prevent unwanted intrusion, but cannot accidentally lock out a person intending to return to the premises. This embodiment does not incorporate a true deadbolt since a retracting force on the deadbolt would disengage the lock.

The present invention is symmetrical for use on both right and left handed doors without installer modification and is compact enough to be used on virtually any door. These embodiments create a true deadbolt, a bolt incapable of being unlocked unless the lock itself is intentionally released. The lock is supported by the strength of the spindle and lock plate and is resistance to forced rotation.

The invention claimed is:

1. A rotary latch assembly comprising:

a. a housing with a spindle opening;

b. a handle with a spindle engagement means and a lock tab engaging means, the handle being rotatably mounted to the housing with the spindle engagement means aligned with the housing spindle opening;

c. a bolt rotatably mounted to the handle for movement between an extended position and a retracted position;

d. a lock plate including a lock tab and a spindle opening defining a spindle locking feature and a spindle release feature, the lock plate being mounted to the housing for movement between a locked position with the locking feature aligned with the housing spindle opening, and an unlocked position with the release feature aligned with the housing spindle opening; and e. bias means for engaging engagement edges of the lock plate, thereby securing the lock plate in its locked or unlocked position, wherein the bias means includes at least one ball guide supporting a ball spring and ball, positioned such that the ball engages the engagement edges of the lock plate to fix the position of the lock plate when in its locked or unlocked positions.

2. A rotary latch assembly comprising:

a. a housing with a spindle opening;

b. a handle with a spindle engagement means and a lock tab engaging means, the handle being rotatably mounted to the housing with the spindle engagement means aligned with the housing spindle opening;

c. a bolt rotatably mounted to the handle for movement between an extended position and a retracted position;

d. a lock plate including a lock tab and a spindle opening defining a spindle locking feature and a spindle release feature, the lock plate being mounted to the housing for movement between a locked position with the locking feature aligned with the housing spindle opening, and an unlocked position with the release feature aligned with the housing spindle opening; and e. bias means for engaging engagement edges of the lock plate, thereby securing the lock plate in its locked or unlocked position, wherein the bias means is at least one leaf spring having lock plate contact surfaces, a housing contact surface and a lock and unlock contact surface, the leaf spring being positioned between the housing and the lock plate with the leaf spring contact surface engaging the housing and the lock plate contact surfaces in contact with the lock plate, such that upon movement of the lock plate to the locked position, the leaf spring lock surface and lock plate contact surface engages the engagement edge of the lock plate to fix the lock plate in its locked position, and upon movement of the lock plate to its unlocked position, the leaf spring unlock contact surface engages an engagement edge of the lock plate to fix the lock plate in its unlocked position.

3. A rotary latch bolt assembly comprising:

a. a housing including a spindle opening and bias means for fixing the position of a lock plate;

b. a handle rotatable mounted to the housing;

c. a bolt rotatable mounted to the handle for movement between an extended position for engagement with a door latch strike and a retracted position for disengagement from a door latch strike;

d. a spindle secured by one end to the handle for rotational movement therewith, and extending from the handle through the housing;

e. a lock plate having a stem and a spindle opening defining a locking feature and a non-engagement feature, mounted within the housing for movement between a locked position with the locking feature in locking engagement with the spindle and the stem in locking engagement with the bolt to prevent movement of the bolt and handle, and an unlocked position with the spindle extended through the non-engagement feature and the stem disengaged from the bolt to permit movement of the bolt and handle; and f. a base for securing the lock plate within the housing in engagement with the bias means;

g. a means of locking the bolt in the extended position, the means of locking the bolt being disposed on the stem; and wherein the housing includes a stop located on the housing and further including a tab defining a tab recess, slideably mounted to the lock plate stem for movement between a locked position with the tab positioned in engagement with the bolt and the stop positioned within the tab recess to prevent movement of the bolt and an unlocked position with the tab disengaged from the bolt and stop to permit movement of the bolt.

* * * * *